US008448584B2

(12) United States Patent
Apps

(10) Patent No.: US 8,448,584 B2
(45) Date of Patent: May 28, 2013

(54) PALLET ASSEMBLY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/537,592

(22) Filed: Jun. 29, 2012

(65) Prior Publication Data

US 2012/0266785 A1 Oct. 25, 2012

Related U.S. Application Data

(63) Continuation of application No. 13/311,621, filed on Dec. 6, 2011, now Pat. No. 8,210,108, which is a continuation of application No. 10/899,550, filed on Jul. 26, 2004, now Pat. No. 8,091,487, which is a continuation of application No. 10/040,098, filed on Oct. 19, 2001, now Pat. No. 6,807,910.

(51) Int. Cl.
*B65D 19/38* (2006.01)

(52) U.S. Cl.
USPC ..... 108/57.25; 108/901

(58) Field of Classification Search
USPC ..... 108/51.11, 56.1, 56.3, 57.25–57.26, 108/57.33–57.34, 901–902
See application file for complete search history.

(56) References Cited

U.S. PATENT DOCUMENTS

| | | | |
|---|---|---|---|
| 3,572,535 | A | 3/1971 | Kinzie |
| 3,610,173 | A | 10/1971 | McIlwraith |
| 3,699,902 | A | 10/1972 | Allgeyer et al. |
| 4,727,102 | A | 2/1988 | Scarso |
| 4,735,154 | A | 4/1988 | Hemery |
| 5,413,052 | A | 5/1995 | Breezer et al. |
| 5,676,064 | A | 10/1997 | Shuert |
| 5,687,532 | A | 11/1997 | Torrey |
| 5,687,652 | A | 11/1997 | Ruma |
| 5,879,495 | A | 3/1999 | Evans |
| 6,199,488 | B1 | 3/2001 | Favaron et al. |
| 6,228,914 | B1 | 5/2001 | Ford et al. |
| 6,250,234 | B1 | 6/2001 | Apps |
| 6,283,044 | B1 | 9/2001 | Apps |
| 6,294,114 | B1 | 9/2001 | Muirhead |
| 6,305,301 | B1 | 10/2001 | Piper, Jr. et al. |
| 6,344,508 | B1 | 2/2002 | Endo et al. |
| 6,389,990 | B1 | 5/2002 | Apps |
| 6,718,888 | B2 | 4/2004 | Muirhead |
| 6,784,234 | B2 | 8/2004 | Adedeji et al. |
| 6,998,433 | B2 | 2/2006 | Overholt et al. |
| 7,378,463 | B2 | 5/2008 | Abu-Isa |
| 7,735,430 | B2 | 6/2010 | Muirhead |
| 2001/0029874 | A1 | 10/2001 | Muirhead |

(Continued)

FOREIGN PATENT DOCUMENTS

| | | |
|---|---|---|
| EP | 0806539 | 11/1997 |

(Continued)

*Primary Examiner* — Hanh V Tran
(74) *Attorney, Agent, or Firm* — Carlson, Gaskey & Olds PC

(57) ABSTRACT

A pallet assembly includes a top deck having a top deck upper surface and a top deck lower surface and also having a first predetermined fire retardancy. A bottom deck having a bottom deck upper surface and a bottom deck lower surface, and also having a second predetermined fire retardancy. A column extending between the top deck and bottom deck, the column having an other fire retardancy lower than at least one of the first and second fire retardancies.

18 Claims, 6 Drawing Sheets

U.S. PATENT DOCUMENTS

| | | | |
|---|---|---|---|
| 2001/0031807 | A1 | 10/2001 | Adedeji et al. |
| 2002/0175435 | A1 | 11/2002 | Weiland et al. |
| 2003/0079658 | A1 | 5/2003 | Torrey et al. |
| 2003/0079660 | A1 | 5/2003 | Torrey et al. |
| 2004/0261669 | A1 | 12/2004 | Apps |
| 2006/0004134 | A1 | 1/2006 | Overholt et al. |

FOREIGN PATENT DOCUMENTS

| | | |
|---|---|---|
| JP | 11-278485 | 10/1999 |
| WO | 00/01588 | 1/2000 |
| WO | 00/20495 | 4/2000 |
| WO | 02/16214 | 2/2002 |
| WO | 03/035495 | 5/2003 |
| WO | 03/035496 | 5/2003 |

PALLET ASSEMBLY

REFERENCE TO RELATED APPLICATIONS

This is a continuation of U.S. patent application Ser. No. 13/311,621 filed Dec. 6, 2011 now U.S. Pat. No. 8,210,108, which is a continuation of U.S. patent application Ser. No. 10/899,550 filed Jul. 26, 2004 now U.S. Pat. No. 8,091,487, which is a continuation of U.S. patent application Ser. No. 10/040,098 filed Oct. 19, 2001, now U.S. Pat. No. 6,807,910 granted Oct. 26, 2004.

BACKGROUND OF THE INVENTION

1. Field of the Invention

The present invention relates to a pallet assembly.

2. Background Art

Pallets formed of molded plastic material have distinct advantages over those made of wood or metal. While wood pallets have sufficient stiffness, they are heavy; are subject to warpage, splintering and splitting; are nonuniform in strength; and gain significant weight when wet. Metallic pallets typically are expensive and, in the case of steel, heavy and subject to corrosion. Plastic pallets are stronger, lighter and more durable than wooden pallets. Heretofore, fire retardance as it relates to plastic pallets has not been recognized as an issue. However, recently, plastic pallets have been the subject of standards promulgated by the National Fire Protection Association (NFPA), Underwriters Laboratories Inc. (UL), Factory Mutual Research Company (FMRC), and National Association of Fire Marshals.

Some standards allow for plastic pallets to be used the same as wood pallets when experimental data show equivalency in the burning and suppression characteristics between the plastic and wood pallets. Unfortunately, some material presently used to help promote fire retardance in plastic pallets, such as an engineered resin blend of high-impact polystyrene and polyphenylene oxide, is very expensive and thus not cost efficient to mold an entire pallet from this material. Such material may also not be as injection-molding friendly as other polymeric materials.

Therefore, a pallet is desired which is accepted by the fire community as having burn and suppression properties substantially similar or better than wood, is relatively inexpensive, lightweight, and easy to manufacture.

SUMMARY OF THE INVENTION

It is an object according to the present invention to provide a pallet which is desired which is accepted by the fire community as having burn properties equivalent to wood.

It is another object according to the present invention to provide a pallet which as the desired level of stiffness, is relatively inexpensive, lightweight, and easy to manufacture.

It is another object according to the present invention to provide a multi-component pallet which allows for the freedom to allocate different materials among the various components to achieve desired properties and characteristics.

In accordance with the objects of the present invention, provided is a pallet assembly includes a top deck having a top deck upper surface and a top deck lower surface and also having a first predetermined fire retardancy. A bottom deck having a bottom deck upper surface and a bottom deck lower surface, and also having a second predetermined fire retardancy. A column extending between the top deck and bottom deck, the column having an other fire retardancy lower than at least one of the first and second fire retardancies.

In another embodiment, a pallet assembly includes a first deck member and a second deck member mounted to the first deck member, the second deck member having a first predetermined fire retardancy. A third deck member spaced from the second deck member and a fourth deck member mounted to the third deck member, the fourth deck member having a second predetermined fire retardancy. At least one column member extends between the second and third deck members, and having a third predetermined fire retardancy lower than that of the second and fourth decks. The third deck member may have a fire retardancy substantially equivalent to that of the at least one column member. Further, at least one elongated reinforcement member may extend within at least one of the top and bottom decks. Also, the top member and mid-top member may have mating ribbed surfaces which are attached to each other, and the bottom member and mid-bottom member have mating ribbed surfaces which are attached to each other.

In another embodiment, provided is a pallet assembly having a first deck member and a second deck member mounted to the first deck member, the second deck member having a predetermined fire retardancy. Also provided is a third deck member spaced from the second deck member and a fourth deck member mounted to the third deck member. It also includes at least one column member extending between the second and third deck members and attached thereto. The first deck member, third deck member, fourth deck member and the at least one column member each has an other predetermined fire retardancy which is less than that of the second deck member.

Another embodiment is directed to a pallet assembly having a horizontally-disposed first portion formed of a polymeric material and having a first top surface and a first bottom surface, the first portion having a first predetermined fire retardancy. Also included is a horizontally-disposed second portion formed of a polymeric material and having a second top surface and a second bottom surface, the second portion having a second predetermined fire retardancy. It further includes at least one vertically-disposed portion extending between the first portion and second portion and having an other predetermined fire retardancy less than that of the first and second portions. The first portion is a pallet top deck, the second portion is a pallet bottom deck, and the vertically-disposed portion is a column.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIGS. 2*a*, 2*b*, and 2*c* are alternate exploded views of FIG. 1.

DETAILED DESCRIPTION OF THE PREFERRED EMBODIMENT(S)

Figure 1:
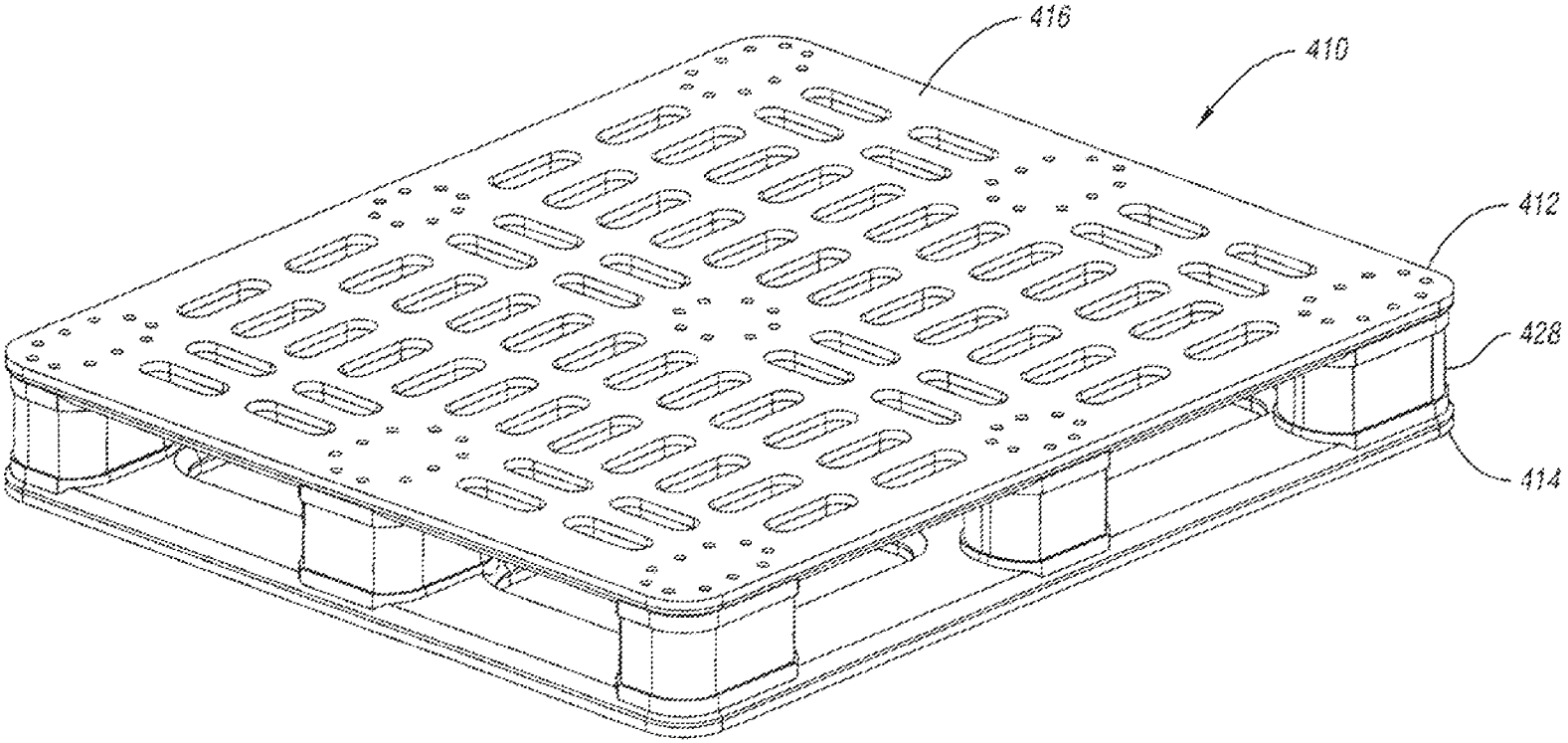
FIG. 1 is a perspective view of a first embodiment of a pallet assembly according to the present invention.
Figure 2:
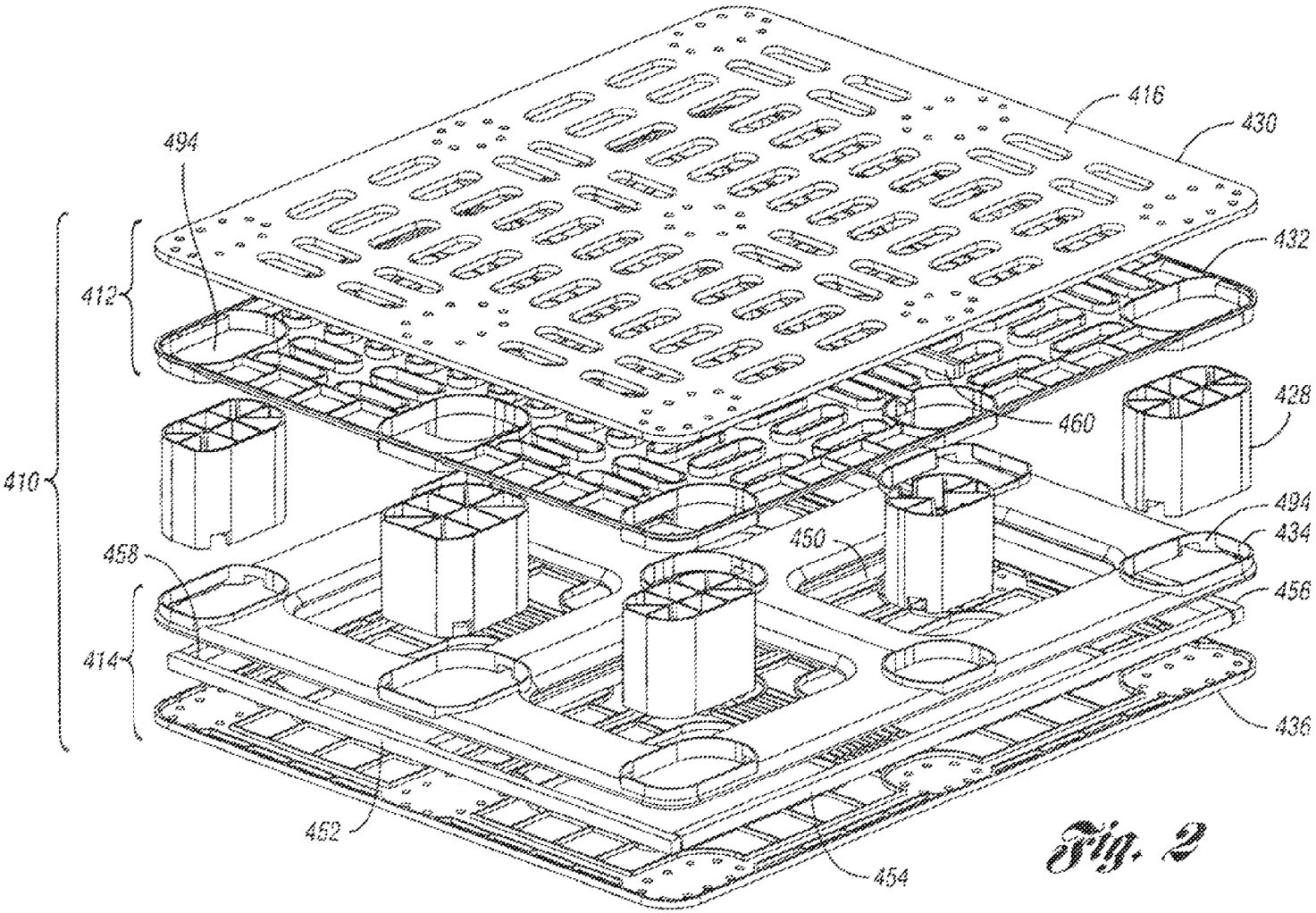
FIG. 2 is an exploded perspective view of FIG. 1.

A pallet assembly according to the present invention is illustrated in FIGS. 1-2 as pallet assembly 410. Pallet assembly 410 includes the following: a top deck 412 having a top portion 430 and a mid-top portion 432; a bottom deck 414 having a mid-bottom portion 434 and a bottom portion 436; and a plurality of column members 428.

While pallet assembly 410 may be used in the same environments as other pallets disclosed herein, it is particularly well-suited to a pallet assembly which seeks to enhance the properties of its individual components, and doing so in a cost efficient manner when feasible. For example, due to their positioning within pallet 410, column members 428 are subject to repeated impact by fork lift tines. Thus, in a preferred embodiment, columns 428 may be molded from a plastic material or composite that provides high impact resistance. Upper and lower decks 412, 414 on the other hand may not require a high impact resistant material, but instead may be formed of a material that has relatively high friction coefficient, high stiffness, high fire retardant characteristics (one which improves the burning and suppression characteristics) properties of the pallet.

With regard to the burn and suppression characteristics of a pallet, the present invention teaches that the horizontal portions of a pallet (i.e. the decks), and particularly the underside of the decks, have a greater exposure to flame during burn as flames are traveling upwards, and thus have a relatively greater influence on the pallet burn rate than the vertical portions of a pallet (i.e. the columns). Accordingly, for a pallet seeking to incorporate fire retardant material into its design in an effective and cost efficient manner, it is unexpectedly taught herein that the entire pallet does not need to be formed of fire retardant material, but instead selected components may be formed thereof. One embodiment according to the present invention teaches that the horizontal portions of the pallet have a predetermined level of fire retardance, while the vertical portions have minimal or no fire retardance, and in any event less than the horizontal portions. Thus, in keeping with these teachings, the decks 412, 414 (the horizontal surfaces) of pallet 410 are formed of a polymeric material having fire retardant properties, typically by including a fire retardant resin or additive to a plastic carrier, thereby defining a predetermined level of fire retardance. On the other hand, the columns 428 (the vertical surfaces) may be formed separately from a high impact material or other type of polymer material which also has little or no flame retardance, and thus has a predetermined level of flame retardant which is less than decks 412, 414.

Figure 3:
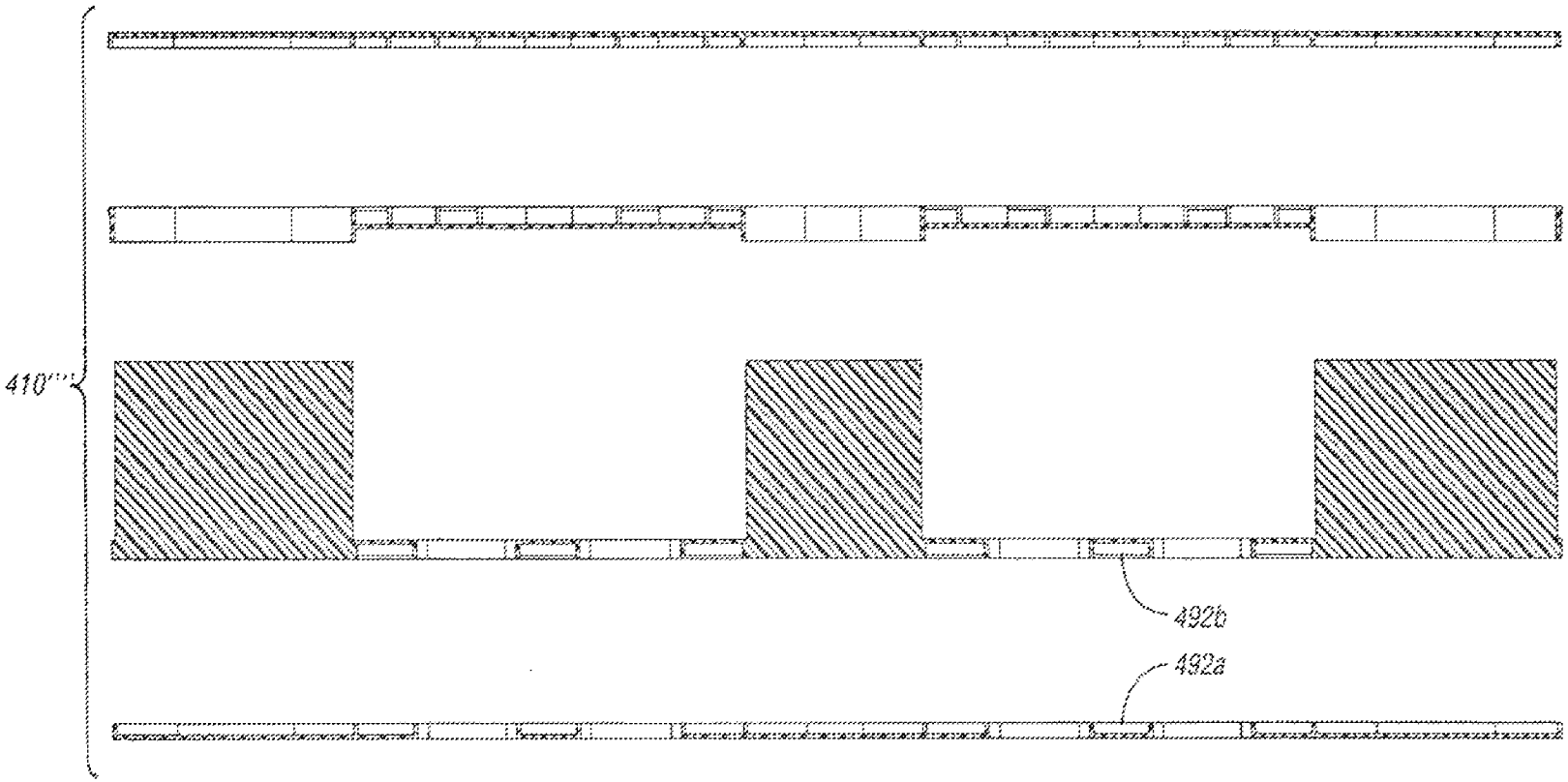
FIG. 3 is an exploded cross-sectional view of an alternate embodiment according to the present invention.

More particularly, for one deck pallets and two deck pallets, the present invention further teaches that the upper horizontal portion of a pallet (i.e. the top deck components) has the greatest affect on the burn rate of a pallet than the other portions of the pallet. Accordingly, in keeping with the teachings according to the present invention, top deck 412 of pallet 410 is formed of a plastic material having a predetermined level of flame retardance, while the columns 428 and lower horizontal surfaces (the bottom deck 414) may be formed separately from a high impact material or other type of polymer material which has little or no flame retardant material, and in any event has less than top deck 412. In such an embodiment, the columns may be integrally formed with the bottom deck of the same material (FIG. 3).

In a pallet having multiple deck portions, the present invention further teaches that the horizontal lower portion of each deck has a greater affect on the burn and suppression rate of a pallet than the other deck portions and column portions. Thus, in a preferred embodiment, mid-top portion 432 and bottom portion 436 of pallet 410 are formed of a plastic material each having a predetermined level of flame retardance which is higher than that of the remaining components of the pallet. Again, the remaining components may be little or no fire retardance properties.

Even more particularly for pallets having multiple deck portions, in a more preferred embodiment, it is taught herein that the horizontal lower portion of the top deck has the greatest affect on the burn rate of a pallet and therefore requires a higher level of fire suppression than the other pallet components. Accordingly, mid-top portion 432 has a predetermined level of flame retardance which is higher than that of the remaining components of the pallet. In such an embodiment, the columns may be integrally formed with the mid-bottom deck portion of the same material (FIG. 3).

Pallet assembly 410 may also include reinforcement members therein. Bottom deck 414 includes a cross-reinforcement member 450 and peripheral reinforcement members 452, 454, 456, 458. Top deck 412 includes a cross-reinforcement member 460 which lies in a plane parallel to but along an axis perpendicular to that of reinforcement member 450.

Joining the pallet components to each other may be performed by means known to those in the art. For example, the columns may be press fit into the decks, or may be snapped together into the decks by a snap attachment (one type is shown in U.S. Pat. No. 6,006,677). The parts may also be welded via a welding for dissimilar materials.

Thus, this pallet embodiment allows only those desired components to be formed from a fire retardant material, such that the pallet may have the desired fire retardant, and burn and suppression characteristics. This pallet also allows the manufacturer the freedom to selectively control and allocate the material and/or amount of fire retardant additive in each component. Accordingly, this provides a lower cost pallet, since the entire pallet no longer needs to be formed of a single material, particularly a more costly single fire retardant material. Accordingly, the desired fire retardant levels for each pallet component and for the overall pallet may be achieved for obtaining desired pallet burn and suppression characteristics in a cost efficient manner, so that the pallet disclosed herein may meet the industry specifications, such as those outlined by, and including but not limited to, NFPA 13, FMRC 4995, and UL 2335, incorporated herein by reference. Thus, the fire retardant additives may be adjusted such that the pallet as a whole meets the desired guidelines. Particularly, the burn and suppression characteristics should be substantially equivalent or better than a similarly sized wood pallet, such as one made from hard wood. Accordingly, the pallet should have a fire rating and burn rate no higher than wood. The particular materials used may be those known in the art for producing fire retardant characteristics in pallets, including but not limited to commodity items, such as polymer resins like polyolefins having a halogen based flame retardant resin additive.

Figure 2A:
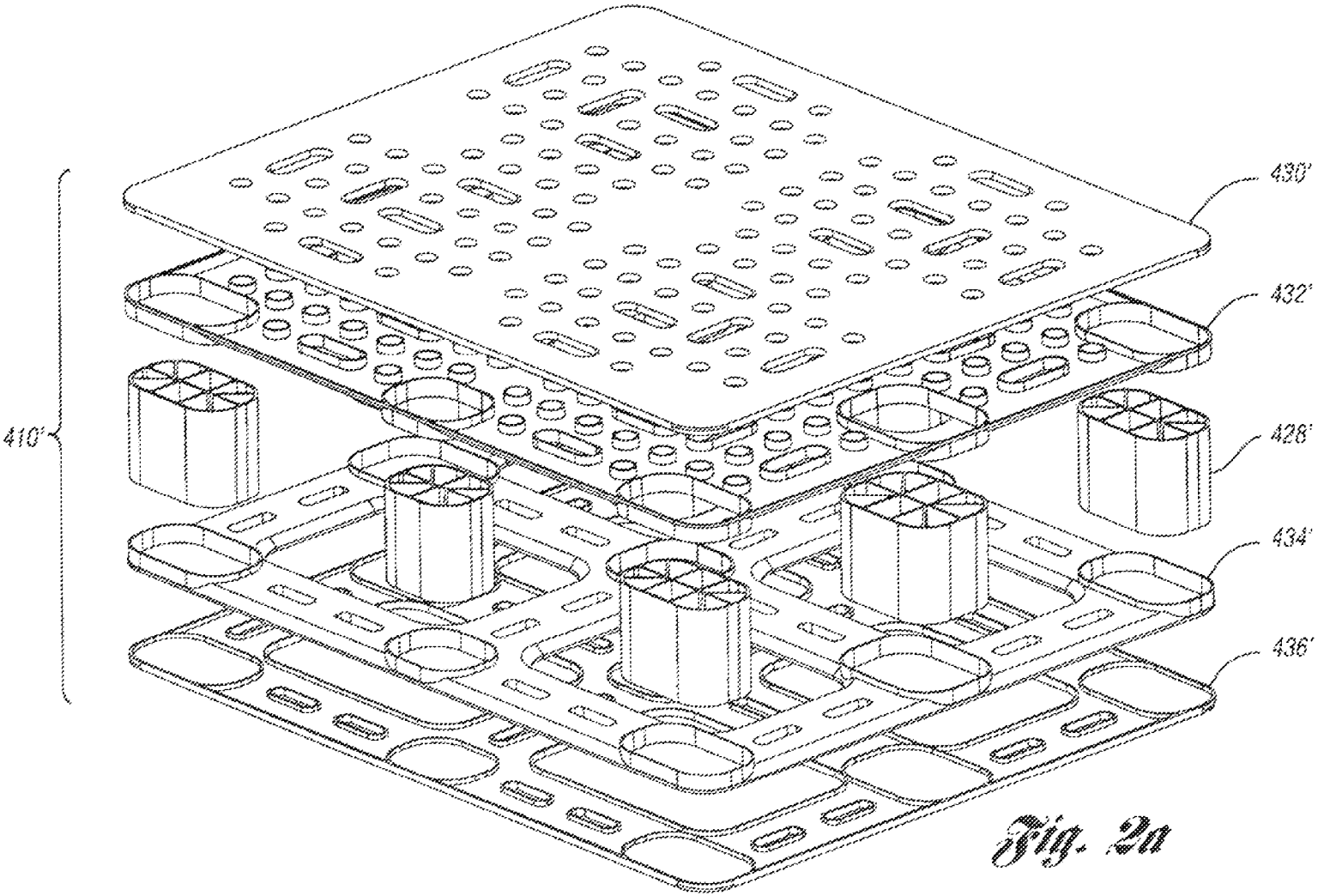
Figure 26:
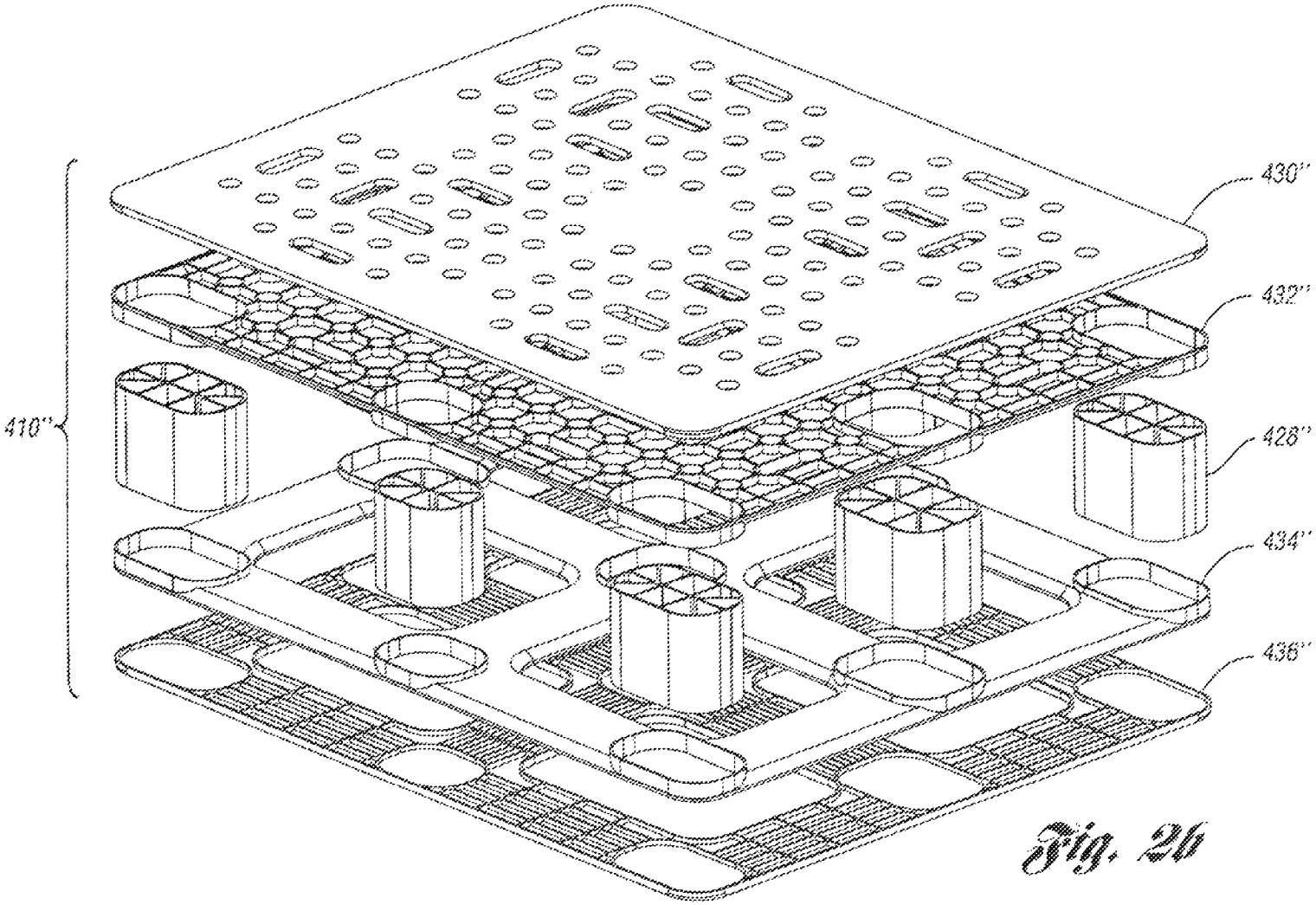
Figure 2C:
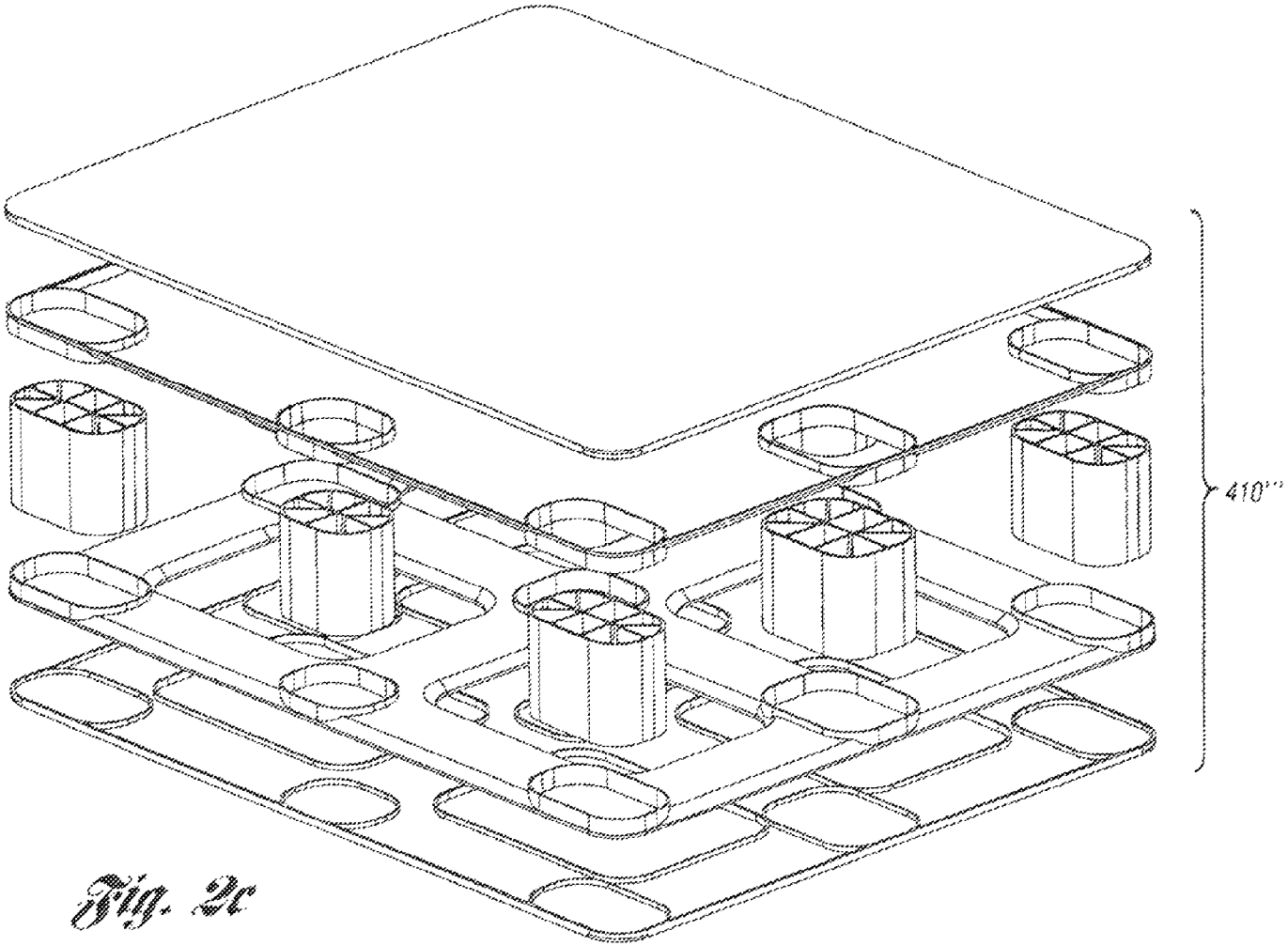

Of course, as illustrated herein, these teachings are applicable to pallets of any size, design, and to those manufactured by various processes. By way of example and not limitation, the teachings herein may also apply to reinforced pallets (FIG. 2) or to pallets without additional reinforcement in the top and/or bottom decks (FIGS. 2*a*, 2*b*, 2*c*). The teachings may also apply to pallets having internal ribbing, cross-ribbing, and box-beams 492*a,b* (FIG. 3), or to pallets without (FIG. 2*c*). They are applicable to one deck pallets, two deck pallets, and pallets formed from multiple deck portions. Because some fire retardant additives may cause some polymer carriers to lose some stiffness, the teachings herein are particularly applicable to reinforced pallets.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet assembly comprising:

a first deck including a first portion having a plurality of downwardly protruding ribs, the first deck further including a second portion mounted to the plurality of downwardly protruding ribs of the first portion, the first portion formed of a first plastic having a first fire retardancy and the second portion formed of a second plastic having a second fire retardancy; and a plurality of columns extending transversely to the first deck, the plurality of columns formed of a third plastic having a third fire retardancy, the second fire retardancy higher than the first fire retardancy and the third fire retardancy.

2. The pallet assembly of claim 1 wherein the plurality of columns are formed integrally with one another.

3. The pallet assembly of claim 2 further including a second deck spaced apart from the first deck, the second deck formed integrally with the plurality of columns.

4. The pallet assembly of claim 3 wherein the second deck includes a third portion and a fourth portion, and the fourth portion is formed of the second plastic.

5. The pallet assembly of claim 4 wherein the third portion includes a plurality of downwardly protruding ribs, the fourth portion secured to the ribs of the third portion.

6. The pallet assembly of claim 4 wherein the first deck is an upper deck and the second deck is a lower deck.

7. The pallet assembly of claim 1 wherein the first plastic and the third plastic are the same.

8. The pallet assembly of claim 1 further including an elongated reinforcement member disposed between the first portion and the second portion of the first deck.

9. The pallet assembly of claim 1 wherein the second plastic includes a fire retardant resin.

10. The pallet assembly of claim 1 wherein the second plastic includes an additive in a plastic carrier.

11. A pallet assembly comprising:

an upper deck including a top portion and a mid-top portion covering at least a portion of an underside of the top portion, wherein the top portion has a first fire retardancy and the mid-top portion has a second fire retardancy greater than the first fire retardancy;

a lower deck spaced apart from the upper deck; and a plurality of columns integrally formed with the lower deck.

12. The pallet assembly of claim 11 wherein the plurality of columns are formed integrally with one another.

13. The pallet assembly of claim 11 wherein the lower deck includes a mid-bottom portion and a bottom portion.

14. The pallet assembly of claim 13 wherein the bottom portion and the mid-top portion are formed of a common plastic.

15. The pallet assembly of claim 13 wherein the top portion and the mid-bottom portion are formed of a common plastic.

16. The pallet assembly of claim 11 further including an elongated reinforcement member disposed between the top portion and the mid-top portion of the first deck.

17. The pallet assembly of claim 11 wherein a plastic of the mid-top portion includes a fire retardant resin.

18. The pallet assembly of claim 11 wherein a plastic of the mid-top portion includes an additive in a plastic carrier.

* * * * *